US010950928B2

(12) United States Patent
Akimoto et al.

(10) Patent No.: US 10,950,928 B2
(45) Date of Patent: Mar. 16, 2021

(54) ANTENNA DEVICE

(71) Applicant: Mitsubishi Electric Corporation, Tokyo (JP)

(72) Inventors: Shimpei Akimoto, Tokyo (JP); Takashi Yanagi, Tokyo (JP); Yasuhiro Nishioka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/485,086

(22) PCT Filed: Mar. 24, 2017

(86) PCT No.: PCT/JP2017/012087
§ 371 (c)(1),
(2) Date: Aug. 9, 2019

(87) PCT Pub. No.: WO2018/173271
PCT Pub. Date: Sep. 27, 2018

(65) Prior Publication Data

US 2020/0028250 A1 Jan. 23, 2020

(51) Int. Cl.

| | |
|---|---|
| ***H01Q 1/12*** | (2006.01) |
| ***H01Q 1/36*** | (2006.01) |
| ***H01Q 1/50*** | (2006.01) |

(52) U.S. Cl.
CPC ..... *H01Q 1/364* (2013.01); *H01Q 1/12* (2013.01); *H01Q 1/50* (2013.01)

(58) Field of Classification Search
CPC .. H01Q 1/12; H01Q 1/26; H01Q 1/40; H01Q 1/50; H01Q 1/243; H01Q 1/364; H01Q 1/521; H01Q 9/28; H01Q 9/32; H01Q 21/29
See application file for complete search history.

(56) References Cited

U.S. PATENT DOCUMENTS

| | | | | |
|---|---|---|---|---|
| 5,349,365 | A * | 9/1994 | Ow | H01Q 11/08 333/26 |
| 6,552,693 | B1 * | 4/2003 | Leisten | H01Q 11/08 343/895 |
| 9,112,273 | B2 * | 8/2015 | Christie | H01Q 11/08 |
| 9,537,203 | B2 | 1/2017 | Akimoto et al. | |
| 9,941,578 | B2 * | 4/2018 | Gardner | H01Q 1/48 |
| 10,181,639 | B2 * | 1/2019 | Naito | H01Q 1/366 |
| 2006/0022891 | A1 * | 2/2006 | O'Neill, Jr. | H01Q 11/08 343/895 |

(Continued)

FOREIGN PATENT DOCUMENTS

| | | | |
|---|---|---|---|
| JP | 5980452 | B2 | 8/2016 |
| WO | WO 2015/115333 | A1 | 8/2015 |

*Primary Examiner* — Tung X Le
(74) *Attorney, Agent, or Firm* — Birch, Stewart, Kolasch & Birch, LLP

(57) ABSTRACT

A line conductor is configured so as to be arranged between a lower surface conductor and an upper surface conductor in parallel with the lower surface conductor in such a way as to extend around the periphery of a hollow cylindrical conductor in a state in which an end is connected to a side surface of the hollow cylindrical conductor and another end is open. As a result, efficient supply of power to a conductive liquid can be performed without disposing a conducting tube having a length of approximately λ/4 at an operating frequency.

8 Claims, 7 Drawing Sheets

(56) References Cited

U.S. PATENT DOCUMENTS

| | | | | |
|---|---|---|---|---|
| 2013/0106667 | A1* | 5/2013 | Fenn | H01Q 1/525 343/793 |
| 2016/0308273 | A1 | 10/2016 | Akimoto et al. | |
| 2018/0138599 | A1* | 5/2018 | Shehan | H01Q 13/06 |
| 2019/0393608 | A1* | 12/2019 | Aliakbarian | H01Q 5/50 |

* cited by examiner

ANTENNA DEVICE

TECHNICAL FIELD

The present disclosure relates to an antenna device that emits a conductive liquid toward the outside.

BACKGROUND ART

The sizes of antenna devices are generally determined by wavelengths corresponding to their operating frequencies. Therefore, the heights of antenna devices having low operating frequencies may reach several meters to several tens of meters.

As for antenna devices having low operating frequencies, it is generally necessary to erect a metallic pole having a length of several meters to several tens of meters on a ground surface, and to construct a foundation for supporting the long metallic pole, and thus in some cases, it is difficult to install antenna devices.

Because antenna devices using a conductive liquid as a radiating element need not erect a metallic pole on a ground surface, such antenna devices can be installed easily even when the antenna devices have low operating frequencies.

As a conductive liquid, for example, sea water abundant in nature can be used. However, a conductive liquid, such as the sea water, has lower conductivity and a larger loss than metal.

Therefore, in antenna devices using a conductive liquid as a radiating element, it is important to eliminate a loss in a power supply structure as much as possible, and to make it possible to perform efficient supply of power to the conductive liquid.

In following Patent Literature 1, as an antenna device using a conductive liquid as a radiating element, an antenna device in which a feeding point is disposed close to a jet orifice of a conducting tube, and an end of the conducting tube that is apart, by approximately one-quarter wavelength at an operating frequency, from the feeding point toward a conductive liquid supply side is electrically short-circuited to a ground conductor is disclosed.

As a result, because an unnecessary current flowing toward the liquid supply side can be suppressed in this antenna device, it is possible to perform efficient supply of power to the conductive liquid.

CITATION LIST

Patent Literature

Patent Literature 1: WO No. 2015/115333

SUMMARY OF INVENTION

Technical Problem

In the conventional antenna device, it is necessary to, for example, dispose a conducting tube having a length of approximately one-quarter wavelength at an operating frequency in a direction horizontal to an installation surface. Therefore, a problem is that a power supply structure in a direction horizontal to the installation surface increases in size.

The present disclosure is made in order to solve the above-mentioned problem, and it is therefore an object of the present disclosure to provide an antenna device that can perform efficient power supply to a conductive liquid without disposing a conducting tube having a length of approximately one-quarter wavelength at an operating frequency.

Solution to Problem

According to the present disclosure, there is provided an antenna device including: a lower surface conductor in which a first hole is formed at a center thereof; an upper surface conductor in which a second hole having a diameter larger than the diameter of the first hole is formed at a center thereof, the upper surface conductor being arranged in parallel with the lower surface conductor in such a way that a central axis of the first hole and a central axis of the second hole correspond to each other; a side surface conductor to connect between an outer peripheral portion of the lower surface conductor and an outer peripheral portion of the upper surface conductor; a hollow cylindrical conductor having an inner diameter identical to the diameter of the first hole, and an outer diameter smaller than the diameter of the second hole, a lower end portion thereof being connected to the lower surface conductor in such a way that the central axis of the first hole and a central axis of the inner diameter correspond to each other; a line conductor that is arranged between the lower surface conductor and the upper surface conductor in parallel with the lower surface conductor in such a way as to extend around the periphery of the hollow cylindrical conductor in a state in which an end thereof is connected to a side surface of the hollow cylindrical conductor and another end thereof is open; and a feeding point in which an end thereof is connected to the lower surface conductor and another end thereof is connected to the line conductor, and to which an alternating voltage is applied, in which a conductive liquid supplied from the first hole passes through an inside of the hollow cylindrical conductor, and is emitted from the inside of the hollow cylindrical conductor toward an outside.

Advantageous Effects of Invention

According to the present disclosure, the line conductor is arranged between the lower surface conductor and the upper surface conductor in parallel with the lower surface conductor in such a way as to extend around the periphery of the hollow cylindrical conductor in the state in which one end is connected to the side surface of the hollow cylindrical conductor and the other end is open, so that there is an advantage in that the efficient supply of power to the conductive liquid can be performed without disposing a conducting tube having a length of approximately one-quarter wavelength at an operating frequency.

DESCRIPTION OF EMBODIMENTS

Hereafter, in order to explain the present disclosure in greater detail, embodiments of the present disclosure will be described with reference to the accompanying drawings.

Embodiment 1

Figure 1:
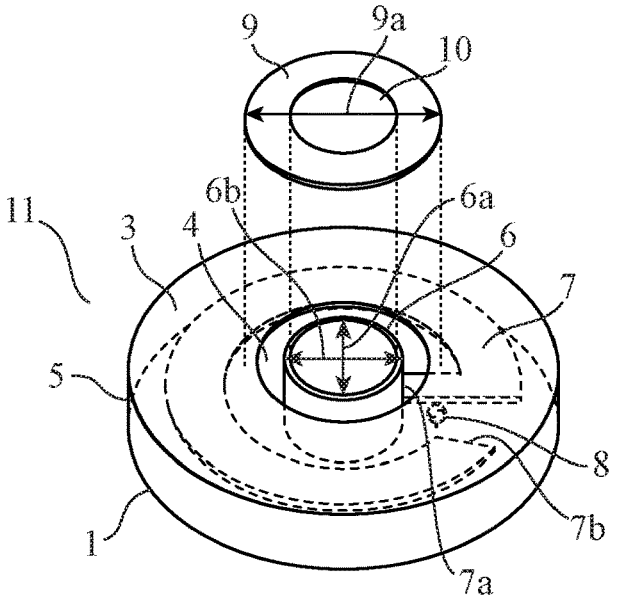
FIG. 1 is a perspective view showing an antenna device according to Embodiment 1 of the present disclosure.
Figure 2:
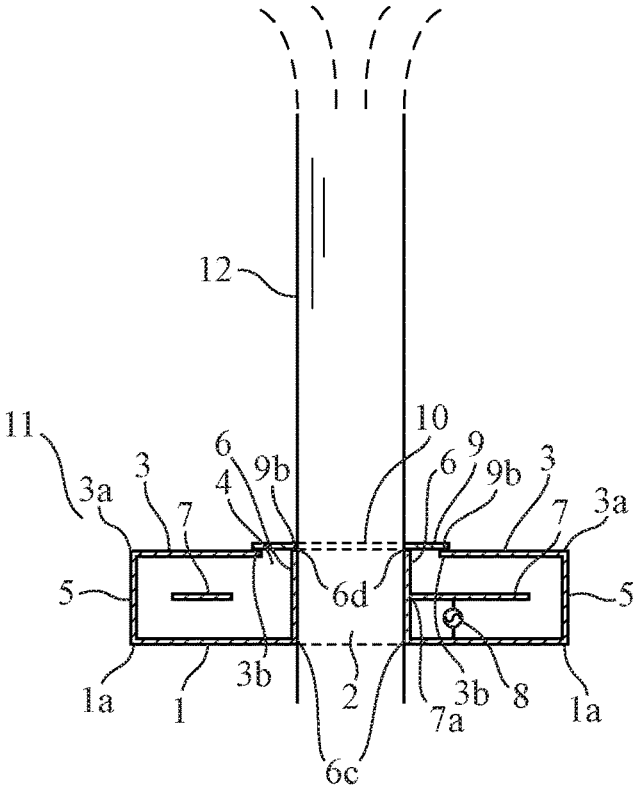
FIG. 2 is a cross-sectional view showing the antenna device according to Embodiment 1 of the present disclosure.

FIG. 1 is a perspective view showing an antenna device according to Embodiment 1 of the present disclosure, and FIG. 2 is a cross-sectional view showing the antenna device according to Embodiment 1 of the present disclosure.

In FIGS. 1 and 2, a lower surface conductor 1 is a disk-shaped one having a finite size, and a first hole 2 that is a circular hole is formed at the center.

An upper surface conductor 3 is a disk-shaped one having the same size as the lower surface conductor 1, and a second hole 4 whose diameter is larger than that of the first hole 2 is formed at the center.

Further, the upper surface conductor 3 is arranged in parallel with the lower surface conductor 1 in such a way that the central axis of the first hole 2 and the central axis of the second hole 4 correspond to each other.

A side surface conductor 5 connects an outer peripheral portion 1*a* of the lower surface conductor 1 and an outer peripheral portion 3*a* of the upper surface conductor 3.

A hollow cylindrical conductor 6 has an inner diameter 6*a* identical to the diameter of the first hole 2 provided in the lower surface conductor 1, and an outer diameter 6*b* smaller than the second hole 4 provided in the upper surface conductor 3.

Further, the hollow cylindrical conductor 6 has a length in a tube axial direction (in FIG. 2, in an upward or downward direction on the page) that is the same as the distance from the lower surface conductor 1 to the upper surface conductor 3, and a lower end portion 6*c* is connected to the lower surface conductor 1 in such a way that the central axis of the first hole 2 and the central axis of the inner diameter 6*a* correspond to each other.

A line conductor 7 is a planar one that is arranged between the lower surface conductor 1 and the upper surface conductor 3 in parallel with both the lower surface conductor 1 and the upper surface conductor 3 in such a way as to extend around the periphery of the hollow cylindrical conductor 6 in a state in which an end 7*a* thereof is connected to a side surface of the hollow cylindrical conductor 6 and another end 7*b* thereof is open.

Further, the line length from the end 7*a* to the other end 7*b* of the line conductor 7 is approximately one-quarter wavelength (=λ/4) at an operating frequency f. λ is a wavelength corresponding to the operating frequency f.

Although in this Embodiment 1 the example in which the line length of the line conductor 7 is approximately λ/4 will be explained, the line length is not limited to this example, and, for example, the line length of the line conductor 7 may be N times (N=1, 2, as long as λ/4.

A feeding point 8 has an end connected to the lower surface conductor 1 and another end connected to the line conductor 7.

The feeding point 8 applies an alternating voltage between the lower surface conductor 1 and the line conductor 7 when connected to a not-illustrated transmitter/receiver.

A waterproof cover 9 is an insulating disk whose diameter 9*a* is larger than that of the second hole 4. The waterproof cover 9 should just be an insulating disk, and is, for example, a disk made from resin.

A third hole 10 having the same diameter as the inner diameter 6*a* of the hollow cylindrical conductor 6 is provided at the center of the waterproof cover 9.

In the waterproof cover 9, the central axis of the third hole 10 corresponds to the central axis of the hollow cylindrical conductor 6, and a bottom surface 9*b* is in close contact with both an upper end portion 6*d* in the hollow cylindrical conductor 6 and an upper surface 3*b* in the upper surface conductor 3.

As a result, the infiltration of water into a cavity constituted by the lower surface conductor 1, the upper surface conductor 3, the side surface conductor 5, and the hollow cylindrical conductor 6 is prevented.

A power supply structure 11 of the antenna device of this Embodiment 1 includes the lower surface conductor 1, the upper surface conductor 3, the side surface conductor 5, the hollow cylindrical conductor 6, the line conductor 7, the feeding point 8, and the waterproof cover 9.

A conductive liquid 12 is supplied from the first hole formed in the lower surface conductor 1, passes through the inside of the hollow cylindrical conductor 6, and is emitted from the third hole 10 toward the outside, and acts as a radiating element.

Next, operations will be explained.

For example, the connection of a transmitter/receiver to the feeding point 8 causes an alternating voltage having a high frequency to be applied between the lower surface conductor 1 and the line conductor 7.

The application of an alternating voltage having a high frequency between the lower surface conductor 1 and the line conductor 7 causes the line conductor 7 arranged between the lower surface conductor 1 and the upper surface conductor 3 to operate as a strip line, so that power having a high frequency is transmitted through the line conductor 7.

Figure 3:
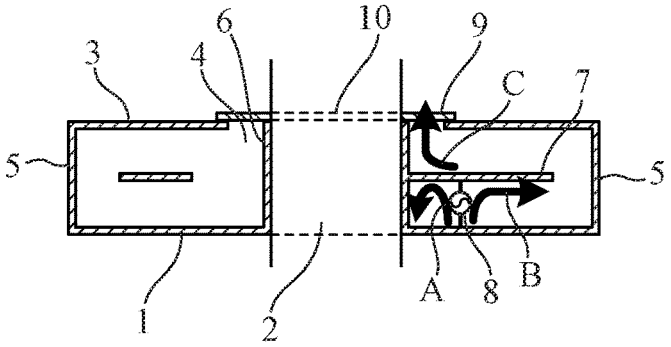
FIG. 3 is a schematic view showing a transmission path of high-frequency power on conductors in the antenna device according to Embodiment 1 of the present disclosure.

FIG. 3 is a schematic view showing a transmission path of high-frequency power on the conductors in the antenna device according to Embodiment 1 of the present disclosure.

High-frequency power is transmitted while being divided into parts transmitted through three paths: a path A short-circuited to the lower surface conductor 1 via the hollow cylindrical conductor 6, a path B extending toward an open end that is the other end 7*b* of the line conductor 7, and a path C extending toward the second hole 4.

Figure 4:
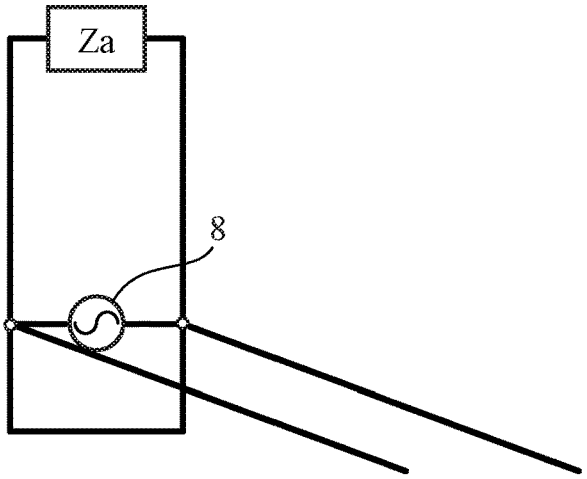
FIG. 4 is an equivalent circuit showing the antenna device according to Embodiment 1 of the present disclosure.

FIG. 4 is an equivalent circuit showing the antenna device according to Embodiment 1 of the present disclosure.

In FIG. 4, $Z_a$ denotes the input impedance of the conductive liquid 12 acting as a radiating element.

Because the high-frequency power transmitted from the feeding point 8 to the path A is short-circuited to the lower surface conductor 1 via the hollow cylindrical conductor 6, a short stub is formed.

At this time, impedance $Z_{short}$ that is provided when the short circuit point is viewed from the feeding point 8 is expressed as shown in the following equation (1).

$$Z_{short}=jZ_0 \tan\{(2\pi/\lambda)L_{short}\} \quad (1)$$

$Z_0$: the characteristic impedance of a transmission line constituted by the lower surface conductor 1, the upper surface conductor 3, and the line conductor 7

$L_{short}$: the distance from the feeding point 8 to the short circuit point λ: the wavelength corresponding to the operating frequency f j: the imaginary unit As is clear from the equation (1), in a case in which the distance $L_{short}$ from the feeding point 8 to the short circuit point is equal to or less than λ/4, the impedance $Z_{short}$ that is provided when the short circuit point is viewed from the feeding point 8 exhibits inductive behavior.

Because the other end 7*b* of the line conductor 7 is open for the high-frequency power transmitted from the feeding point 8 to the path B, an open stub is formed.

At this time, impedance $Z_{open}$ that is provided when the open end is viewed from the feeding point 8 is expressed as shown in the following equation (2).

$$Z_{open}=jZ_0 \cot\{(2\pi/\lambda)L_{open}\} \quad (2)$$

$L_{open}$: the distance from the feeding point 8 to the open end that is the other end 7*b* of the line conductor 7

As is clear from the equation (2), in a case in which the distance $L_{open}$ from the feeding point 8 to the open end of the line conductor 7 is equal to or less than λ/4, the impedance $Z_{open}$ that is provided when the open end is viewed from the feeding point 8 exhibits capacitive behavior.

In this Embodiment 1, because the line length of the line conductor 7 is approximately λ/4, the following equation (3) is established.

$$L_{open}=\lambda 4-L_{short} \quad (3)$$

At this time, impedance $Z_p$ that is provided when a parallel circuit including the short stub and the open stub is viewed from the feeding point 8 is expressed as shown in the following equation (4).

$$\begin{aligned} 1/Z_p &= 1/Z_{short} + 1/Z_{open} \\ &= 1/[jZ_0\tan\{(2\pi/\lambda)L_{short}\}] + j/[Z_0\cot\{(2\pi/\lambda)L_{open}\}] \end{aligned} \quad (4)$$

By substituting the equation (3) into the equation (4), the impedance $Z_p$ is expressed as shown in the following equation (5).

$$\begin{aligned} 1/Z_p &= 1/[jZ_0\tan\{(2\pi/\lambda)L_{short}\}] + j/[Z_0\cot\{(2\pi/\lambda)(\lambda/4 - L_{short})\}] \\ &= 1[jZ_0\tan\{(2\pi/\lambda)L_{short}\}] + j/[Z_0\cot\{(\pi/2) - (2\pi/\lambda)L_{short}\}] \\ &= 1/[jZ_0\tan\{(2\pi/\lambda)L_{short}\}] + j/Z_0\tan\{(2\pi/\lambda)L_{short}\} \\ Z_p &= [1/\{(1/j) + j\}][Z_0\tan\{(2\pi/\lambda)L_{short}\}] \end{aligned} \quad (5)$$

In the equation (5), because (1/j)+j=0, the impedance $Z_p$ is as shown in the following equation (6).

$$Z_p=\infty \quad (6)$$

It is seen from the above description that in the case in which the line length of the line conductor 7 is λ/4, the reactance component of the transmission line constituted by the lower surface conductor 1, the upper surface conductor 3, and the line conductor 7 is canceled regardless of the distance $L_{short}$ from the feeding point 8 to the short circuit point. More specifically, the reactance component of the transmission line is canceled regardless of the position of the feeding point 8.

Thus, the impedance $Z_p$ that is provided when the parallel circuit including the short stub and the open stub is viewed from the feeding point 8 becomes infinite.

Thus, because both the path A and the path B enter an open state, no high-frequency power is transmitted to the paths, but high-frequency power is transmitted only to the path C.

Therefore, it becomes possible to supply high-frequency power only to the conductive liquid 12 acting as a radiating element.

The input impedance $Z_a$ of the conductive liquid 12 acting as a radiating element greatly changes dependently upon both the thickness and the conductivity of the conductive liquid 12 jetted out from the third hole 10.

In a case in which the input impedance $Z_a$ of the conductive liquid 12 acting as a radiating element greatly differs from input impedance $Z_{in}$ at the feeding point 8, the high-frequency power transmitted from the feeding point 8 is not efficiently supplied to the conductive liquid 12.

In this Embodiment 1, it is possible to change the input impedance $Z_{in}$ by changing the position of the feeding point 8 disposed between the lower surface conductor 1 and the line conductor 7.

In general, the input impedance $Z_{in}$ is equal to the ratio of voltage to current at the feeding point 8. The magnitude of the resistance component is the largest if the feeding point 8 is disposed at the open end of the line conductor 7 where the intensity of an electric field is the highest.

Further, the magnitude of the resistance component decreases as the feeding point 8 gets closer to the end 7*a* of the line conductor 7 that is a connection point between the line conductor 7 and the hollow cylindrical conductor 6.

Therefore, no matter what value the input impedance $Z_a$ of the conductive liquid 12 acting as a radiating element has, a match can be achieved between the input impedance $Z_a$ of the conductive liquid 12 and the input impedance $Z_{in}$ at the feeding point 8 by adjusting the position of the feeding point 8.

Therefore, it becomes possible to efficiently supply the high-frequency power transmitted from the feeding point 8 to the conductive liquid 12 by adjusting the position of the feeding point 8.

Next, an advantage of the antenna device of this Embodiment 1 will be considered by taking, as an example, a case in which sea water is used as the conductive liquid 12.

Figure 5:
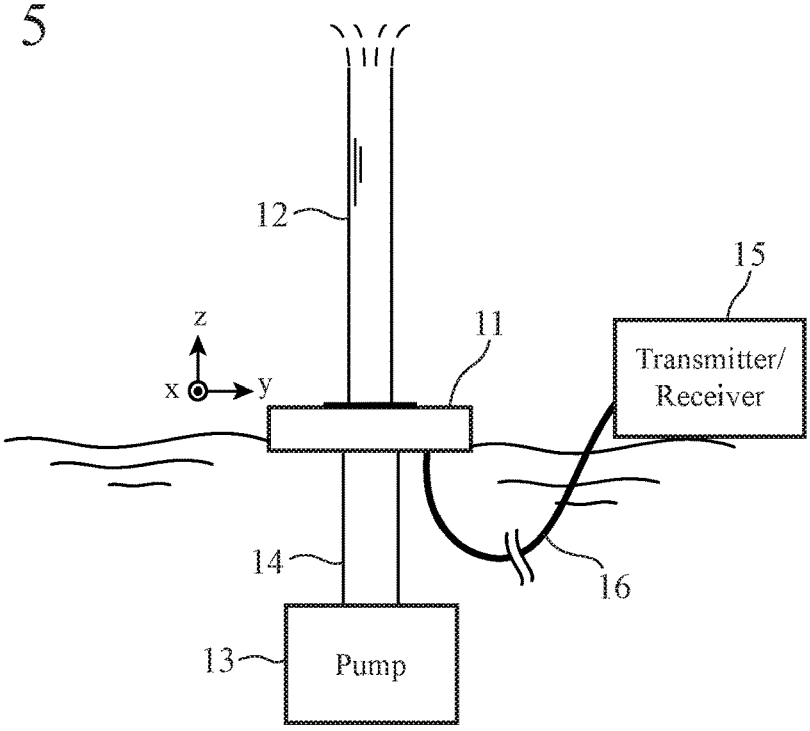
FIG. 5 is a side view in a case in which a pump 13 is connected to a power supply structure 11 of the antenna device according to Embodiment 1 of the present disclosure, and the power supply structure 11 of the antenna device is arranged at sea level.

FIG. 5 is a side view in a case in which a pump 13 is connected to the power supply structure 11 of the antenna device according to Embodiment 1 of the present disclosure, and the power supply structure 11 of the antenna device is arranged at sea level.

Figure 6:
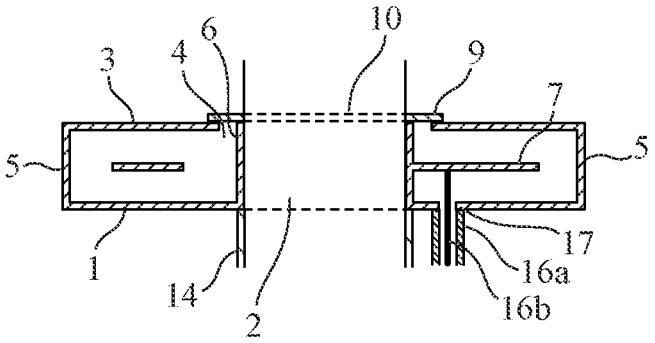
FIG. 6 is a cross-sectional view showing the power supply structure 11 of the antenna device of FIG. 5.

FIG. 6 is a cross-sectional view showing the power supply structure 11 of the antenna device of FIG. 5.

In the example of FIGS. 5 and 6, both the diameter of the lower surface conductor 1 and the diameter of the upper surface conductor 3 are approximately one-tenth (=λ/10) of the wavelength λ corresponding to the operating frequency f, and the spacing between the lower surface conductor 1 and the upper surface conductor 3 is approximately one-sixtieth (=λ/60) of the wavelength λ corresponding to the operating frequency f.

Further, the length in the tube axial direction of the hollow cylindrical conductor 6 is also approximately λ/60.

Further, both the diameter of the first hole 2 and the inner diameters 6*a* of the hollow cylindrical conductor 6 are approximately λ/30, and the length of the conductive liquid 12 jetted out from the third hole 10 is approximately λ/4.

In this Embodiment 1, as long as the line length of the line conductor 7 is approximately λ/4, the other sizes are not limited.

In FIGS. 5 and 6, the pump 13 is a machine for supplying sea water to the antenna device of FIG. 1 via a conducting tube 14, and the pump 13 is arranged inside the sea in the example of FIG. 5.

The conducting tube 14 has an end connected to the pump 13, and another end connected to the power supply structure 11 of the antenna device.

The conducting tube 14 is a hollow one for sending sea water outputted from the pump 13 to the power supply structure 11 of the antenna device.

No high-frequency power is transmitted from the feeding point 8 to the conducting tube 14 because the path A in FIG. 3 is in the open state as mentioned above. Therefore, the material and the length of the conducting tube 14 are not limited.

A transmitter/receiver 15 is connected to the power supply structure 11 of the antenna device of FIG. 1 via a high frequency cable 16.

In the example of FIG. 5, the transmitter/receiver 15 is arranged at a position sufficiently apart from the power supply structure 11 of the antenna device.

The high frequency cable 16 is a flexible one having a coaxial structure.

At a connection point between the power supply structure 11 of the antenna device and the high frequency cable 16, a hole 17 having the same size as the inner diameter of an outer conductor 16*a* of the high frequency cable 16 is provided in the lower surface conductor 1.

The outer conductor 16*a* of the high frequency cable 16 is connected to the lower surface conductor 1, and an inner conductor 16*b* of the high frequency cable 16 is connected to the line conductor 7.

In the example of FIG. 5, it is assumed that the sea surface is sufficiently wider than the wavelength corresponding to the operating frequency f, and the sea surface is used as a ground conductor.

Figure 7:
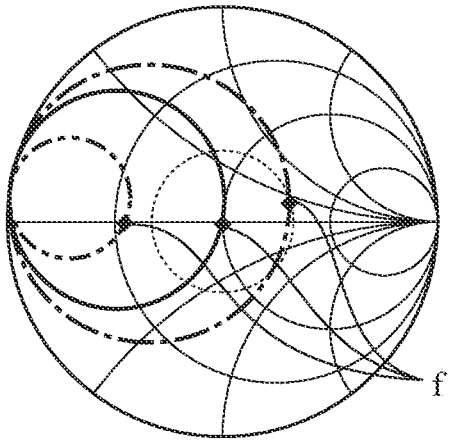
FIG. 7 is an explanatory drawing showing, using a Smith chart, a frequency dependence of input impedance $Z_{in}$ of the antenna device according to Embodiment 1 of the present disclosure.

FIG. 7 is an explanatory drawing showing, using a Smith chart, a frequency dependence of the input impedance $Z_{in}$ of the antenna device according to Embodiment 1 of the present disclosure.

In FIG. 7, both a thin solid circle line and a thin solid circular arc line show the Smith chart.

f denotes a frequency corresponding to a desired operating frequency.

A long dashed short dashed line, a thick line, and a long dashed double-short dashed line show characteristic curves of the input impedance $Z_{in}$.

A difference among the input impedance $Z_{in}$ shown by the long dashed short dashed line, that shown by the thick line, and that shown by the long dashed double-short dashed line is based on changes in the distance between a connection point between the inner conductor 16*b* of the high frequency cable 16 and the line conductor 7, and the connection point between the line conductor 7 and the hollow cylindrical conductor 6.

An example in which the distance shown by the long dashed short dashed line is the longest and the distance shown by the long dashed double-short dashed line is the shortest, among those shown by the long dashed short dashed line, the thick solid line, and the long dashed double-short dashed line, is shown.

Further, a dashed circle corresponds to a voltage standing wave ratio (VSWR)=2 that is a standing wave ratio.

The inside of the dashed circle corresponds to a range in which VSWR is smaller than VSWR=2, and the center of the circle corresponds to VSWR=1.

In the following numerical calculation, it is assumed that as electric constants of sea water, the relative permittivity is 81 and the conductivity is 4 S/m.

It can be seen from FIG. 7 that by adjusting the position of the connection point between the inner conductor 16*b* of the high frequency cable 16 and the line conductor 7, the antenna device of this Embodiment 1 can provide VSWR that is approximately equal to "1", the VSWR indicating a state having a good impedance matching characteristic at the desired operating frequency f.

In this Embodiment 1, because the length of the conductive liquid 12 jetted out from the third hole 10 is equal to λ/4 at the operating frequency f, the conductive liquid 12 enters a resonance state and radiates an electromagnetic wave having a high frequency.

Figure 8:
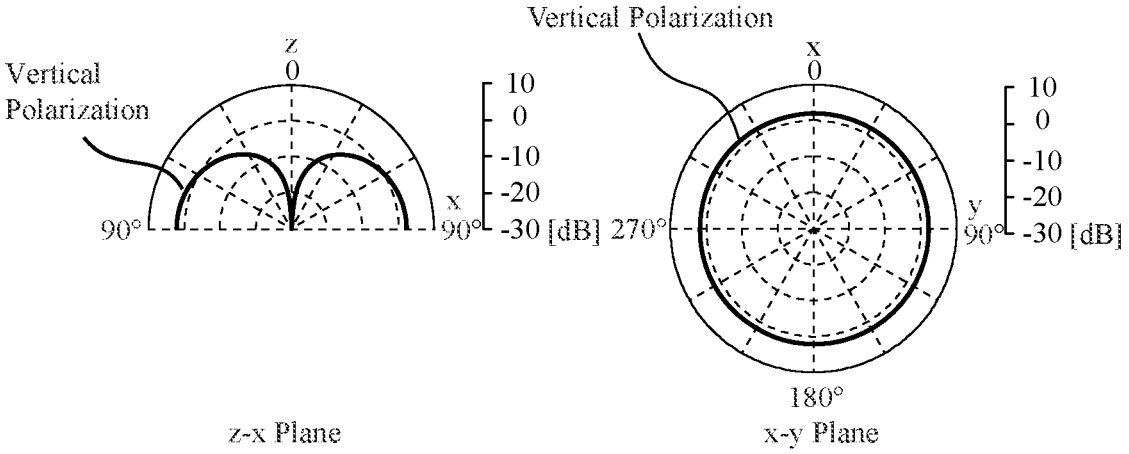
FIG. 8 is an explanatory drawing showing the result of calculation of a radiation pattern at an operation gain in a z-x plane and an x-y plane in an xyz-coordinate system when the xy plane in the antenna device of FIG. 5 is a sea surface.

FIG. 8 is an explanatory drawing showing the result of calculation of a radiation pattern at an operation gain in a z-x plane and an x-y plane in an xyz-coordinate system in a case in which the xy plane in the antenna device of FIG. 5 is a sea surface.

In the z-x plane, a radiation pattern only in an upward direction with respect to the sea surface is shown because sea water spreading infinitely acts as a ground conductor.

The antenna device radiates only a vertically polarized wave that is a main polarized wave, as shown in FIG. 8, and has a figure-eight pattern in the z-x plane and a nearly non-directional pattern in the x-y plane.

Therefore, it is seen that the jetted-out conductive liquid 12 acts as a monopole antenna.

As is clear from the above description, according to this Embodiment 1, because the line conductor 7 is arranged between the lower surface conductor 1 and the upper surface conductor 3 in parallel with the lower surface conductor 1 in such a way as to extend around the periphery of the hollow cylindrical conductor 6 in a state in which the end 7*a* is connected to the side surface of the hollow cylindrical conductor 6 and the other end 7*b* is open, so that there is an advantage in that the efficient supply of power to the conductive liquid 12 can be performed without disposing a conducting tube having a length of approximately λ/4 at the operating frequency f.

Further, a constraint that the length in the tube axial direction of the hollow cylindrical conductor 6 through which the conductive liquid 12 passes and the length of the conducting tube 14 needs to be λ/4 is eliminated, and the power supply structure 11 can be downsized.

Although in the Embodiment 1 the example in which both the lower surface conductor 1 and the upper surface conductor 3 are disk-shaped ones is shown, the embodiment 1 is not limited to this example, and, for example, both the lower surface conductor 1 and the upper surface conductor 3 may be rectangle-shaped ones.

Further, although in this Embodiment 1 the example in which a sea surface is used as a ground conductor is shown, one of the lower surface conductor 1 and the upper surface conductors 3 can be used as a ground conductor by increasing the radius of the one to be sufficiently larger than the wavelength A corresponding to the operating frequency f.

Embodiment 2

In above-mentioned Embodiment 1, the example in which the conductive liquid 12 is jetted out from the third hole 10 formed in the waterproof cover 9 to right above is shown.

In this Embodiment 2, an example in which a direction toward which a conductive liquid 12 is jetted out is inclined with respect to a direction right above will be explained.

Figure 9:
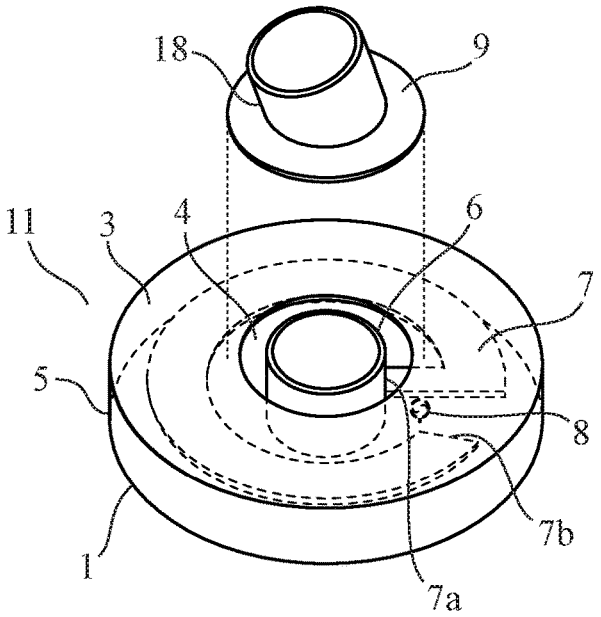
FIG. 9 is a perspective view showing an antenna device according to Embodiment 2 of the present disclosure.
Figure 10:
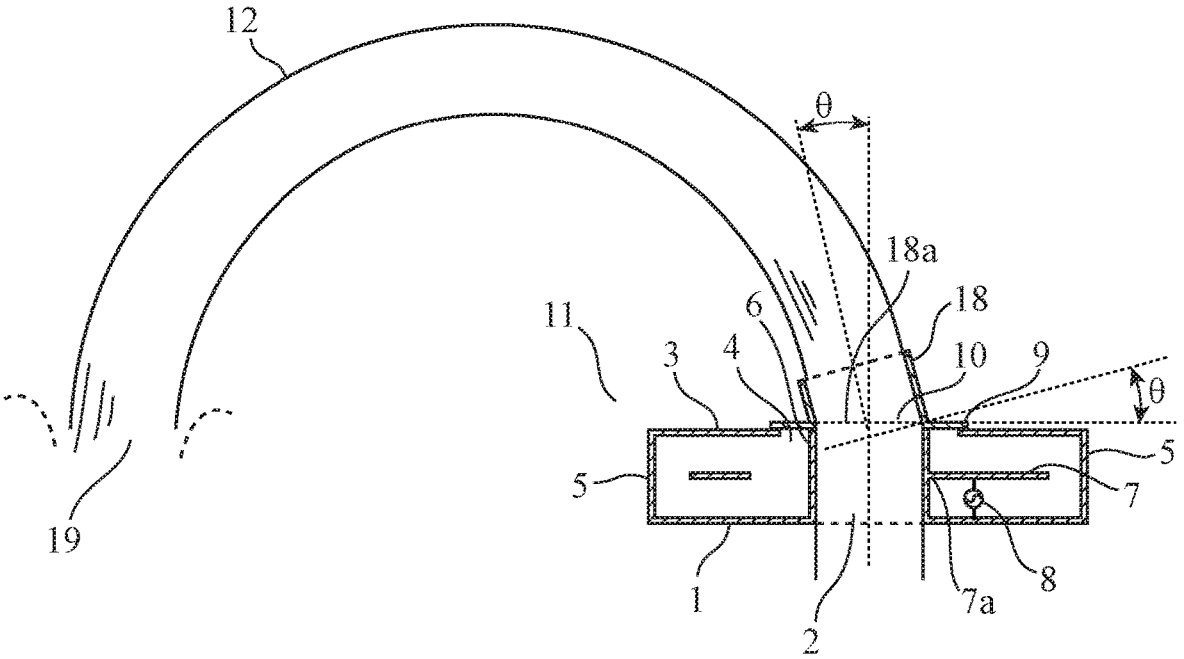
FIG. 10 is a cross-sectional view showing the antenna device according to Embodiment 2 of the present disclosure.

FIG. 9 is a perspective view showing an antenna device according to Embodiment 2 of the present disclosure, and FIG. 10 is a cross-sectional view showing the antenna device according to Embodiment 2 of the present disclosure.

In FIGS. 9 and 10, because the same reference signs as those shown in FIGS. 1 and 2 denote the same components or like components, an explanation of the components will be omitted hereafter.

A guide 18 is a hollow cylinder made from resin and having an inner diameter that is substantially the same as that of a third hole 10 formed in a waterproof cover 9.

The guide 18 is a member that changes the direction of emission of a conductive liquid 12 in such a way that an angle θ between a central axis of a hollow cylindrical conductor 6 and a central axis of the conductive liquid 12 emitted from the third hole 10 formed in the waterproof cover 9 toward the outside is equal to or greater than 0 degrees and less than 90 degrees.

A lower end portion 18*a* of the guide 18 is cut at an angle equal to the angle θ in such a way that the angle θ between the central axis of the hollow cylindrical conductor 6 and the central axis of the conductive liquid 12 is equal to or greater than 0 degrees and less than 90 degrees.

The guide 18 is arranged while being in close contact with an upper surface of the waterproof cover 9, in such a way that an inner edge of the lower end portion 18*a* of the guide 18 is aligned with the third hole 10 formed in the waterproof cover 9.

Next, operations will be explained.

In a case in which the conductive liquid 12 is jetted out to right above and the conductive liquid 12 is caused to operate as a monopole antenna, like in the case of above-mentioned Embodiment 1, the jetted-out conductive liquid 12 drops onto a power supply structure 11 of the antenna device as waterdrops.

If the conductive liquid 12 close to the third hole 10 serving as the basis of a radiating element, and an upper surface conductor 3 are electrically short-circuited to each other because of dropping waterdrops (conductive liquid 12), degradation in the antenna characteristics or instability of the antenna characteristics is caused.

To solve this problem, in this Embodiment 2, waterdrops are prevented from dropping onto the power supply structure 11 by inclining the direction in which the conductive liquid 12 is jetted out from the third hole 10 with respect to a direction right above by using the guide 18.

As a result, a short circuit between the conductive liquid 12 close to the third hole 10 serving as the basis of a radiating element, and the upper surface conductor 3 is prevented, so that degradation in the antenna characteristics or instability of the antenna characteristics can be prevented.

Further, because the emission direction of the conductive liquid 12 is inclined, a loop antenna can be formed as shown in FIG. 10.

For example, by making the length of the conductive liquid 12 extending from the third hole 10 serving as the basis of a radiating element to a liquid landing point 19 be approximately equal to λ/2, the conductive liquid 12 is caused to enter a resonance state and an electromagnetic wave having a high frequency is radiated from the conductive liquid 12.

As is clear from the above description, according to this Embodiment 2, because the guide 18 that changes the emission direction of the conductive liquid 12 in such a way that the angle θ between the central axis of the hollow cylindrical conductor 6 and the central axis of the conductive liquid 12 emitted from the third hole 10 toward the outside is equal to or greater than 0 degrees and less than 90 degrees is disposed on the upper surface of the waterproof cover 9, there is provided an advantage of preventing a short circuit between the conductive liquid 12 close to the third hole 10 serving as the basis of a radiating element, and the upper surface conductor 3, thereby being able to prevent degradation in the antenna characteristics or instability of the antenna characteristics.

Embodiment 3

In above-mentioned Embodiments 1 and 2, the example in which high-frequency power having an operating frequency f is supplied to the conductive liquid 12 is shown.

In this Embodiment 3, an antenna device that can supply either high-frequency power having a first operating frequency $f_1$ or high-frequency power having a second operating frequency $f_2$ to a conductive liquid 12 will be explained.

Figure 11:
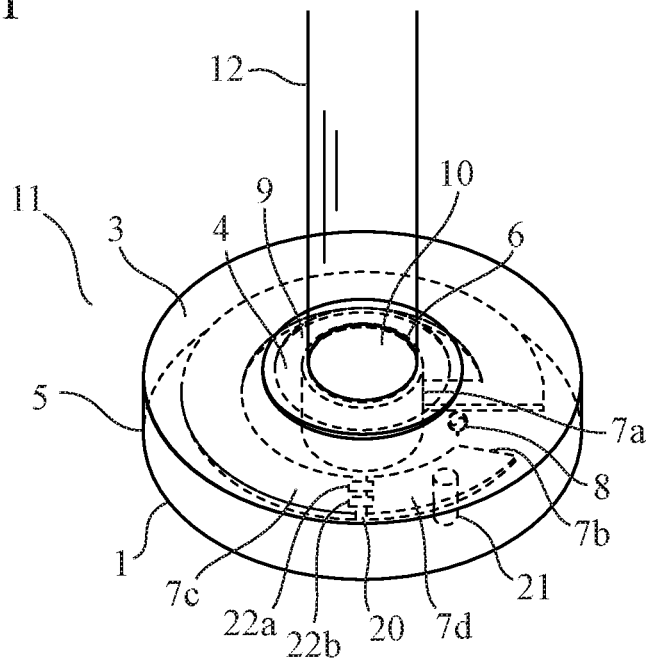
FIG. 11 is a perspective view showing an antenna device according to Embodiment 3 of the present disclosure.
Figure 12:
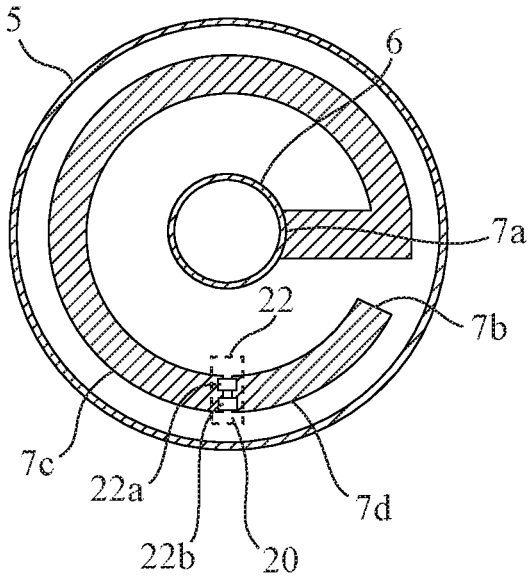
FIG. 12 is a cross-sectional view showing the antenna device according to Embodiment 3 of the present disclosure.

FIG. 11 is a perspective view showing the antenna device according to Embodiment 3 of the present disclosure, and FIG. 12 is a cross-sectional view showing the antenna device according to Embodiment 3 of the present disclosure.

In FIGS. 11 and 12, because the same reference signs as those shown in FIGS. 1 and 2 denote the same components or like components, an explanation of the components will be omitted hereafter.

In this Embodiment 3, a line conductor 7 is divided at an intermediate point thereof, a part of the line conductor 7 extending from the division point 20 to an end 7*a* is a first line conductor 7*c*, and a part of the line conductor 7 extending from the division point 20 to another end 7*b* is a second line conductor 7*d*.

A supporting jig 21 is made from resin and supports the second line conductor 7*d* divided at the division point 20.

In this Embodiment 3, a line length that is the sum total of the line length of the first line conductor 7*c* and the line length of the second line conductor 7*d* is approximately one-quarter wavelength ($=\lambda_1/4$) at the first operating frequency $f_1$, $\lambda_1$ is a wavelength corresponding to the first operating frequency $f_1$.

Further, the line length of the first line conductor 7*c* is approximately one-quarter wavelength ($=\lambda_2/4$) at the second operating frequency $f_2$. $\lambda_2$ is a wavelength corresponding to the second operating frequency $f_2$.

A resonant circuit 22 includes an inductor 22*a* that is a first lumped constant element, and a capacitor 22*b* that is a second lumped constant element. The inductor 22*a* and the capacitor 22*b* are connected in parallel in such a way as to connect the first line conductor 7*c* and the second line conductor 7*d* at the division point 20.

The resonant circuit 22 is a band reject filter that blocks high-frequency power having the second operating frequency $f_2$, and allows high-frequency power having the first operating frequency $f_1$ to pass therethrough.

Although in this Embodiment 3 the example in which the resonant circuit 22 is used in the antenna device of FIGS. 1 and 2 is shown, the resonant circuit 22 may be used in the antenna device of FIGS. 9 and 10.

Next, operations will be explained.

In this Embodiment 3, the line conductor 7 is divided at an intermediate point thereof, and the resonant circuit 22 is disposed at the division point 20.

Therefore, high-frequency power having the second operating frequency $f_2$ can be blocked at the division point 20 by adjusting the inductance L of the inductor 22*a* and the capacitance C of the capacitor 22*b*, the inductor and the capacitor being included in the resonant circuit 22.

The following equation (7) shows a relation among the second operating frequency $f_2$, the inductance L of the inductor 22*a*, and the capacitance C of the capacitor 22*b*.

$$f_2=1/\{2\pi(L\cdot C)^{1/2}\} \quad (7)$$

π: Ratio of the circumference of a circle to its diameter

High-frequency power having the first operating frequency $f_1$ passes through the resonant circuit 22. Thus, the line conductor 7 in which the first line conductor 7*c* and the second line conductor 7*d* are connected acts as a strip line in which an end thereof is open at a length of one-quarter of the wavelength $\lambda_1$ corresponding to the first operating frequency $f_1$.

As a result, impedance $Z_{p1}$ that is provided when the resonant circuit 22 including a short stub and an open stub is viewed from a feeding point 8 becomes infinite at the first operating frequency $f_1$. Therefore, it is possible to supply high-frequency power having the first operating frequency $f_1$ to the conductive liquid 12 acting as a radiating element.

High-frequency power having the second operating frequency $f_2$ is blocked by the resonant circuit 22. Thus, the first line conductor 7*c* acts as a strip line in which an end thereof is open at a length of one-quarter of the wavelength $\lambda_2$ corresponding to the second operating frequency $f_2$.

As a result, impedance $Z_{p2}$ that is provided when the resonant circuit 22 including the short stub and the open stub is viewed from the feeding point 8 becomes infinite at the second operating frequency $f_2$. Therefore, it is possible to supply high-frequency power having the second operating frequency $f_2$ to the conductive liquid 12 acting as a radiating element.

As is clear from the above description, according to this Embodiment 3, because the resonant circuit 22 that blocks high-frequency power having the second operating frequency $f_2$, and allows high-frequency power having the first operating frequency $f_1$ to pass therethrough is disposed at the division point 20, there is provided an advantage of being able to supply either high-frequency power having the first operating frequency $f_1$ or high-frequency power having the second operating frequency $f_2$ to the conductive liquid 12 acting as a radiating element.

Although in this Embodiment 3 the example in which the number of division points 20 of the line conductor 7 is one is shown, the number of division points 20 of the line conductor 7 may be two or more.

For example, in a case in which the number of division points 20 is N (N is an integer equal to or greater than 2), resonant circuits 22 shown below are disposed at the N division points 20.

(1) The following resonant circuit is disposed as a resonant circuit 22 that is the closest to a hollow cylindrical conductor 6.

A resonant circuit that allows high-frequency power including from high-frequency power having a first operating frequency $f_1$ to high-frequency power having an Nth operating frequency $f_N$ to pass therethrough, and blocks high-frequency power having an (N+1)th operating frequency $f_{N+1}$.

(2) The following resonant circuit is disposed as a resonant circuit 22 that is the second closest to the hollow cylindrical conductor 6.

A resonant circuit that allows high-frequency power including from high-frequency power having the first operating frequency $f_1$ to high-frequency power having an (N−1) th operating frequency $f_{N-1}$ to pass therethrough, and blocks the high-frequency power having the Nth operating frequency $f_N$.

(N) The following resonant circuit is disposed as a resonant circuit 22 that is the farthest from the hollow cylindrical conductor 6.

A resonant circuit that allows the high-frequency power having the first operating frequency $f_1$ to pass therethrough, and blocks high-frequency power having the second operating frequency $f_2$.

Embodiment 4

Figure 13:
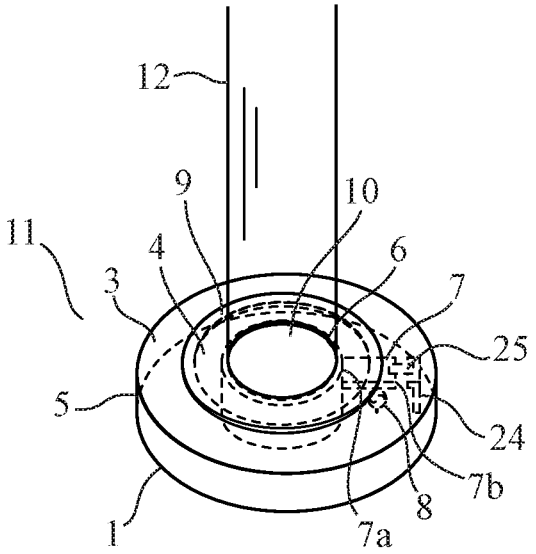
FIG. 13 is a perspective view showing an antenna device according to Embodiment 4 of the present disclosure.
Figure 14:
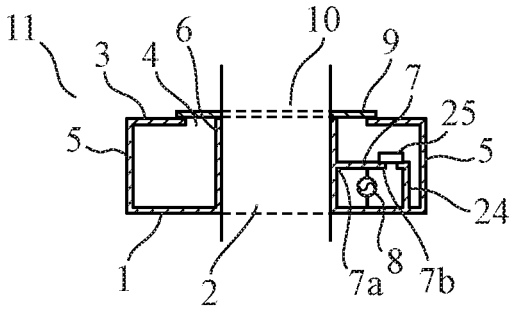
FIG. 14 is a cross-sectional view showing the antenna device according to Embodiment 4 of the present disclosure.

In this Embodiment 4, an example in which another end 7*b* of a line conductor 7 is connected to a short circuiting conductor 24 via a capacitive member 25 as shown in FIGS. 13 and 14 will be explained.

FIG. 13 is a perspective view showing an antenna device according to Embodiment 4 of the present disclosure, and FIG. 14 is a cross-sectional view showing the antenna device according to Embodiment 4 of the present disclosure.

In FIGS. 13 and 14, because the same reference signs as those shown in FIGS. 1 and 2 denote the same components or like components, an explanation of the components will be omitted hereafter.

The short circuiting conductor 24 has an end connected to a lower surface conductor 1, and another end arranged close to an open end of the line conductor 7.

The capacitive member 25 is, for example, a capacitor.

The capacitive member 25 has an end connected to the other end 7*b* of the line conductor 7, and another end connected to the other end of the short circuiting conductor 24.

In this Embodiment 4, the line length of the line conductor 7 is equal to or less than one-quarter wavelength at an operating frequency f.

Although in this Embodiment 4 an example in which the short circuiting conductor 24 and the capacitive member 25 are used in the antenna device of FIGS. 1 and 2 is shown, the short circuiting conductor 24 and the capacitive member 25 may be used in the antenna devices of FIGS. 9 to 12.

Next, operations will be explained.

In the antenna device of this Embodiment 4, the other end 7*b* of the line conductor 7 that is an open end is connected to the lower surface conductor 1 via the capacitive member 25. Therefore, by adjusting the capacitance of the capacitive member 25, the inductivity of impedance $Z_{short}$ that is provided when a short circuit point that is an end 7*a* of the line conductor 7 is viewed from a feeding point 8 can be canceled by the capacitance of the capacitive member 25.

While in above-mentioned Embodiment 1 capacitivity is implemented by a line extending from the feeding point 8 to the open end of the line conductor 7, capacitivity can be implemented by the capacitance of the capacitive member 25 in this Embodiment 4.

Therefore, it is not necessary to make the line length of the line conductor 7 be approximately one-quarter wavelength at the operating frequency f, and the line length of the line conductor 7 can be made to be equal to or less than one-quarter wavelength at the operating frequency f.

Therefore, according to this Embodiment 4, the size of a power supply structure 11 can be further reduced to smaller than that of above-mentioned Embodiment 1.

In this Embodiment 4, although the example in which the other end 7*b* of the line conductor 7 that is an open end is connected to the lower surface conductor 1 via the capacitive member 25 is shown, the other end 7*b* of the line conductor 7 that is an open end may be connected to a side surface conductor 5 or an upper surface conductor 3 via the capacitive member 25.

Further, as the capacitive member 25, a variable capacitor or the like whose capacitance can be changed may be used so as to make it possible for the operating frequency f to be changed.

Embodiment 5

In this Embodiment 5, an antenna device that is formed using a dielectric substrate 26 having a three-layer structure will be explained.

Figure 15:
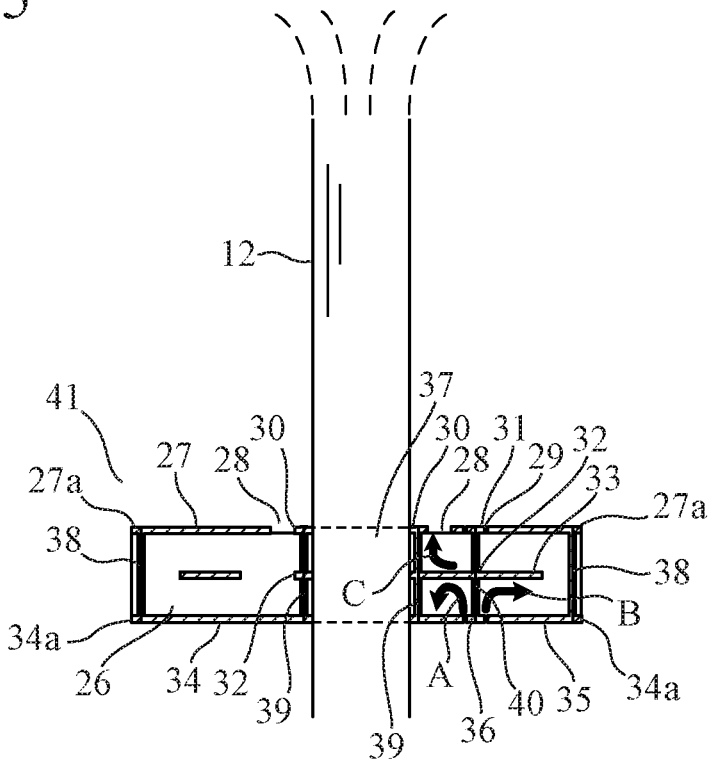
FIG. 15 is a cross-sectional view showing an antenna device according to Embodiment 5 of the present disclosure.

FIG. 15 is a cross-sectional view showing the antenna device according to Embodiment 5 of the present disclosure, and FIG. 16 is an exploded view showing a copper foil pattern in each layer of the antenna device according to Embodiment 5 of the present disclosure.

Figure 16A:
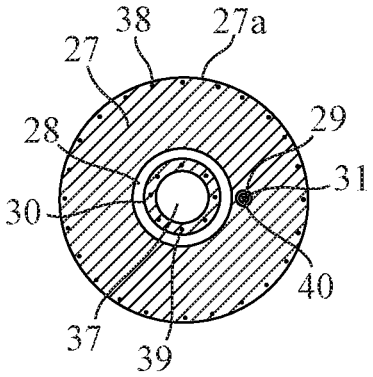
FIG. 16A is a plan view showing a copper foil pattern in a first layer of a dielectric substrate 26.
Figure 16B:
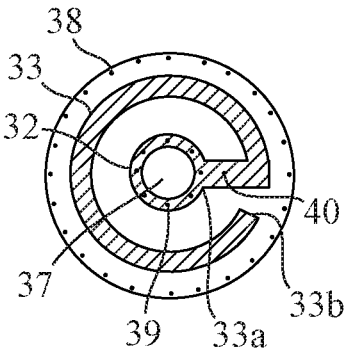
FIG. 16B is a plan view showing a copper foil pattern in a second layer of the dielectric substrate 26.
Figure 16C:
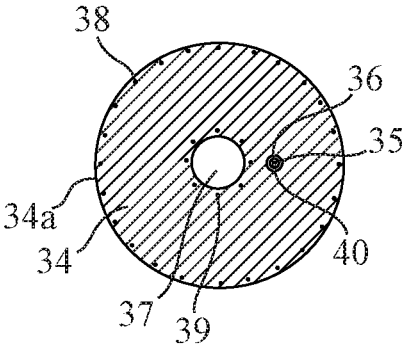
FIG. 16C is a plan view showing a copper foil pattern in a third layer of the dielectric substrate 26.

FIG. 16A is a plan view showing a copper foil pattern in a first layer of the dielectric substrate 26, FIG. 16B is a plan view showing a copper foil pattern in a second layer of the dielectric substrate 26, and FIG. 16C is a plan view showing a copper foil pattern in a third layer of the dielectric substrate 26.

In FIGS. 15 and 16, the dielectric substrate 26 is a disk-shaped dielectric layer in which a penetrating hole 37 having the same size as the first hole 2 shown in FIG. 2 is provided at the center thereof, and this dielectric layer has a three-layer structure. In this Embodiment 5, the first layer, the second layer, and the third layer are arranged in order from the top of the page of FIG. 15.

In the first layer of the dielectric substrate 26, for example, the upper surface conductor 3 shown in FIG. 1 is formed using an upper surface copper foil pattern 27, and the upper end portion 6*d* in the hollow cylindrical conductor 6 shown in FIG. 1 is formed using a jet orifice copper foil pattern 30.

In the second layer of the dielectric substrate 26, for example, the line conductor 7 shown in FIG. 1 is formed using a line copper foil pattern 33, and a part of the hollow cylindrical conductor 6 shown in FIG. 1 is formed using a liquid conducting channel copper foil pattern 32.

In the third layer of the dielectric substrate 26, for example, the lower surface conductor 1 shown in FIG. 1 is formed using a lower surface copper foil pattern 34.

The upper surface copper foil pattern 27 is a disk-shaped conductor, and a hole 28 is formed at the center.

The upper surface copper foil pattern 27 is a conductor corresponding to the upper surface conductor 3 shown in FIG. 1.

At a position apart from the center of the upper surface copper foil pattern 27, a small hole 29 is formed close to the hole 28.

The jet orifice copper foil pattern 30 is a disk-shaped conductor whose diameter is smaller than that of the hole 28, and is arranged in such a way that the central axis thereof corresponds to the central axis of the hole 28.

The jet orifice copper foil pattern 30 is a conductor corresponding to the upper end portion 6*d* in the hollow cylindrical conductor 6 shown in FIG. 1.

The upper surface power supply copper foil pattern 31 is a disk-shaped conductor whose diameter is smaller than that of the small hole 29, and is arranged in such away that the central axis thereof corresponds to the central axis of the small hole 29. The upper surface power supply copper foil pattern 31 acts as a feeding point.

The liquid conducting channel copper foil pattern 32 is a disk-shaped conductor whose diameter is the same as that of the jet orifice copper foil pattern 30, and that corresponds to an intermediate point of the hollow cylindrical conductor 6 shown in FIG. 1.

The line copper foil pattern 33 is a conductor that is arranged in such a way as to extend around the periphery of the liquid conducting channel copper foil pattern 32 in a state in which an end 33*a* thereof is connected to the liquid conducting channel copper foil pattern 32 and another end 33*b* thereof is open, and that corresponds to the line conductor 7 shown in FIG. 1.

A line length from the end 33*a* to the other end 33*b* of the line copper foil pattern 33 is approximately one-quarter wavelength (=λ/4) at an operating frequency f.

The lower surface copper foil pattern 34 is a disk-shaped conductor that has the same size as the upper surface copper foil pattern 27, and that corresponds to the lower surface conductor 1 shown in FIG. 1.

A small hole 35 is formed in the lower surface copper foil pattern 34, has the same size as the small hole 29, and is arranged on the same central axis as the small hole 29.

A lower surface power supply copper foil pattern 36 is a disk-shaped conductor whose diameter is smaller than that of the small hole 35, and is arranged in such a way that the central axis thereof corresponds to the central axis of the small hole 35. The lower surface power supply copper foil pattern 36 acts as a feeding point.

The penetrating hole 37 penetrates the dielectric substrate 26 to extend from the first layer to the third layer.

The penetrating hole 37 has a diameter smaller than that of the jet orifice copper foil pattern 30, and corresponds to the first hole 2 shown in FIG. 2.

A side surface through hole 38 is a first through hole that electrically connects an outer peripheral portion 27*a* of the upper surface copper foil pattern 27 in the first layer of the dielectric substrate 26, and an outer peripheral portion 34*a* of the lower surface copper foil pattern 34 in the third layer of the dielectric substrate 26.

Multiple side surface through holes 38 are arranged, and the spacing between any two of the multiple side surface through holes 38 is shorter than a wavelength λ corresponding to the operating frequency f. Thus, the side surface through holes 38 are a conductor corresponding to the side surface conductor 5 of FIG. 1 that electrically connects the outer peripheral portion 1*a* of the lower surface conductor 1 and the outer peripheral portion 3*a* of the upper surface conductor 3.

A liquid conducting channel through hole 39 is a second through hole that electrically connects the jet orifice copper foil pattern 30 in the first layer and the lower surface copper foil pattern 34 in the third layer.

Multiple liquid conducting channel through holes 39 are arranged, and the spacing between any two of the multiple liquid conducting channel through holes 39 is shorter than the wavelength λ corresponding to the operating frequency f. Thus, the liquid conducting channel through holes 39 are a conductor corresponding to the hollow cylindrical conductor 6 shown in FIG. 1.

A power supply through hole 40 is a third through hole that electrically connects the upper surface power supply copper foil pattern 31 in the first layer, the liquid conducting channel copper foil pattern 32 in the second layer, and the lower surface power supply copper foil pattern 36 in the third layer.

A power supply structure 41 is constituted by the copper foil patterns on the dielectric substrate 26, and the through holes.

A conductive liquid 12 is supplied from an end on a third layer side of the penetrating hole 37 to an inside and is jetted out from an end on the first layer side of the penetrating hole 37 to the outside, and acts as a radiating element.

Next, operations will be explained.

For example, the connection of a transmitter/receiver to between the lower surface power supply copper foil pattern 36 and the lower surface copper foil pattern 34 causes an alternating voltage having a high frequency to be applied between the lower surface copper foil pattern 34 and the line copper foil pattern 33.

The application of an alternating voltage having a high frequency between the lower surface copper foil pattern 34 and the line copper foil pattern 33 causes the line copper foil pattern 33 arranged between the lower surface copper foil pattern 34 and the upper surface copper foil pattern 27 to operate as a strip line, so that power having a high frequency is transmitted through the line copper foil pattern 33.

The high-frequency power is transmitted while being divided into parts transmitted through three paths: a path A short-circuited to the lower surface copper foil pattern 34 via the liquid conducting channel copper foil pattern 32 and the liquid conducting channel through holes 39, a path B extending toward an open end that is the other end 33*b* of the line copper foil pattern 33, and a path C extending toward the jet orifice copper foil pattern 30.

Because the high-frequency power transmitted from the power supply through hole 40 to the path A is short-circuited to the lower surface copper foil pattern 34 via the liquid conducting channel copper foil pattern 32 and the liquid conducting channel through holes 39, a short stub is formed.

Because the other end 33*b* of the line copper foil pattern 33 is open for the high-frequency power transmitted from the power supply through hole 40 to the path B, an open stub is formed.

In a case in which the line length of the line copper foil pattern 33 is λ/4, the reactance component of the transmission line is canceled regardless of the position of the power supply through hole 40.

Therefore, impedance $Z_p$ that is provided when a parallel circuit including the short stub and the open stub is viewed from the power supply through hole 40 becomes infinite.

Therefore, because both the path A and the path B enter an open state, the high-frequency power is not transmitted, and the high-frequency power is transmitted only to the path C.

Therefore, it becomes possible to supply the high-frequency power only to the conductive liquid 12 acting as a radiating element.

The input impedance $Z_a$ of the conductive liquid 12 acting as a radiating element greatly changes depending on both the thickness and the conductivity of the conductive liquid 12 jetted out from the end on the first layer side of the penetrating hole 37.

In a case in which the input impedance $Z_a$ of the conductive liquid 12 acting as a radiating element greatly differs from input impedance $Z_{in}$ that is viewed from the power supply through hole 40, the high-frequency power transmitted from the power supply through hole 40 is not efficiently supplied to the conductive liquid 12.

In this Embodiment 4, it is possible to change the input impedance $Z_{in}$ by changing the position of the power supply through hole 40.

In general, the input impedance $Z_{in}$ is equal to the ratio of voltage to current at the power supply through hole 40. The magnitude of the resistance component is the largest if the power supply through hole 40 is disposed at the open end of the line copper foil pattern 33 where the intensity of an electric field is the largest.

Further, the magnitude of the resistance component decreases as the power supply through hole 40 gets closer to the end 33*a* of the line copper foil pattern 33 that is a connection point between the line copper foil pattern 33 and the liquid conducting channel copper foil pattern 32.

Therefore, no matter what value the input impedance $Z_a$ of the conductive liquid 12 acting as a radiating element has, a match can be achieved between the input impedance $Z_a$ of the conductive liquid 12 and the input impedance $Z_{in}$ that is viewed from the power supply through hole 40 by adjusting the position of the power supply through hole 40.

Therefore, it becomes possible to efficiently supply the high-frequency power transmitted from the power supply through hole 40 to the conductive liquid 12.

As is clear from the above description, this Embodiment 4 provides an advantage of being able to perform efficient supply of power to the conductive liquid 12 without disposing a conducting tube having a length of approximately λ/4 at the operating frequency f, like above-mentioned Embodiment 1.

Further, a constraint that the thickness of the dielectric substrate 26 through which the conductive liquid 12 passes (in FIG. 15, in an upward or downward direction on the page) must be λ/4 is eliminated, and the power supply structure 41 can be downsized.

Further, in this Embodiment 4, by performing etching processing on the dielectric substrate 26, the upper surface copper foil pattern 27, the jet orifice copper foil pattern 30, the upper surface power supply copper foil pattern 31, the liquid conducting channel copper foil pattern 32, the line copper foil pattern 33, the lower surface copper foil pattern 34, and the lower surface power supply copper foil pattern 36 can be formed. In this case, because it is suitable for mass production, reduction in the cost of the antenna device can be achieved.

Although no waterproof cover 9 is disposed in the antenna device of FIG. 15, it needless to say that the waterproof cover 9 may be disposed, like in the case of above-mentioned Embodiment 1.

Further, although no guide 18 is disposed in the antenna device of FIG. 15, it needless to say that the guide 18 may be disposed, like in the case of above-mentioned Embodiment 2.

It is to be understood that any combination of two or more of the above-mentioned embodiments can be made, various changes can be made in any component according to any one of the above-mentioned embodiments, and any component according to any one of the above-mentioned embodiments can be omitted within the scope of the present disclosure.

INDUSTRIAL APPLICABILITY

The present disclosure is suitable for antenna devices that emit a conductive liquid to the outside.

REFERENCE SIGNS LIST

1 lower surface conductor, 1*a* outer peripheral portion of lower surface conductor 1, 2 first hole, 3 upper surface conductor, 3*a* outer peripheral portion of upper surface conductor 3, 3*b* upper surface of upper surface conductor 3, 4 second hole, 5 side surface conductor, 6 hollow cylindrical conductor, 6*a* inner diameter of hollow cylindrical conductor 6, 6*b* outer diameter of hollow cylindrical conductor 6, 6*c* lower end portion of hollow cylindrical conductor 6, 6*d* upper end portion of hollow cylindrical conductor 6, 7 line conductor, 7*a* end of line conductor 7, 7*b* other end of line conductor 7, 7*c* first line conductor, 7*d* second line conductor, 8 feeding point, 9 waterproof cover, 9*a* diameter of waterproof cover 9, 9*b* bottom surface of waterproof cover 9, 10 third hole, 11 power supply structure, 12 conductive liquid, 13 pump, 14 liquid conducting tube, 15 transmitter/receiver, 16 high frequency cable, 16*a* outer conductor of high frequency cable 16, 16*b* inner conductor of high frequency cable 16, 17 hole, 18 guide, 18*a* lower end portion of guide 18, 19 liquid landing point, 20 division point, 21 supporting jig, 22 resonant circuit, 22*a* inductor, 22*b* capacitor, 24 short circuiting conductor, 25 capacitive member, 26 dielectric substrate, 27 upper surface copper foil pattern, 28 hole, 29 small hole, 30 jet orifice copper foil pattern, 31 upper surface power supply copper foil pattern (feeding point), 32 liquid conducting channel copper foil pattern, 33 line copper foil pattern, 33*a* end of line copper foil pattern 33, 33*b* other end of line copper foil patterns 33, 34 lower surface copper foil pattern, 35 small hole, 36 lower surface power supply copper foil pattern (feeding point), 37 penetrating hole, 38 side surface through hole (first through hole), 39 liquid conducting channel through hole (second through hole), 40 power supply through hole (third through hole), and 41 power supply structure.

The invention claimed is:

1. An antenna device comprising:

a lower surface conductor having a first hole formed at a center thereof;

an upper surface conductor having a second hole formed at a center thereof, the second hole having a diameter larger than a diameter of the first hole, the upper surface conductor being arranged in parallel with the lower surface conductor in such a way that a central axis of the first hole and a central axis of the second hole correspond to each other;

a side surface conductor to connect between an outer peripheral portion of the lower surface conductor and an outer peripheral portion of the upper surface conductor;

a hollow cylindrical conductor having an inner diameter identical to the diameter of the first hole, and an outer diameter smaller than the diameter of the second hole, a lower end portion thereof being connected to the lower surface conductor in such a way that the central axis of the first hole and a central axis of the inner diameter correspond to each other;

a line conductor that is arranged between the lower surface conductor and the upper surface conductor in parallel with the lower surface conductor in such a way as to extend around a periphery of the hollow cylindrical conductor in a state in which an end thereof is connected to a side surface of the hollow cylindrical conductor and another end thereof is open; and a feeding point having an end thereof connected to the lower surface conductor and another end thereof connected to the line conductor, the feeding point applying an alternating voltage between the lower surface conductor and the line conductor when connected to a transmitter/receiver, wherein a conductive liquid supplied from the first hole passes through an inside of the hollow cylindrical conductor, and is emitted from the inside of the hollow cylindrical conductor toward an outside.

2. The antenna device according to claim 1, wherein a line length from the end to the other end of the line conductor is one-quarter wavelength at an operating frequency.

3. The antenna device according to claim 1, further comprising a waterproof cover having an outer diameter larger than the diameter of the second hole, and a third hole having a diameter identical to the inner diameter of the hollow cylindrical conductor is formed at a center thereof, wherein a central axis of the third hole corresponds to a central axis of the hollow cylindrical conductor, a bottom surface of the waterproof cover is in contact with both an upper end portion in the hollow cylindrical conductor and an upper surface in the upper surface conductor, and the conductive liquid supplied from the first hole passes through the inside of the hollow cylindrical conductor, and is emitted from the third hole toward an outside.

4. The antenna device according to claim 3, wherein a guide to change a direction of emission of the liquid in such a way that an angle between the central axis of the hollow cylindrical conductor and a central axis of the conductive liquid emitted from the third hole toward an outside is equal to or greater than 0 degrees and less than 90 degrees is disposed in the waterproof cover.

5. The antenna device according to claim 1, wherein the line conductor is divided at an intermediate point thereof, a part of the line conductor extending from a division point to one end side is a first line conductor, a part of the line conductor extending from the division point to another end side is a second line conductor, a line length that is a sum total of a line length of the first line conductor and a line length of the second line conductor is one-quarter wavelength at a first operating frequency, the line length of the first line conductor is one-quarter wavelength at a second operating frequency, and wherein the antenna device comprises a resonant circuit disposed at the division point in such a way as to connect between the first line conductor and the second line conductor, to block high-frequency power having the second operating frequency, and allowing high-frequency power having the first operating frequency to pass therethrough.

6. The antenna device according to claim 1, wherein a dielectric substrate having the first hole formed at the center thereof has three-layer structure, the upper surface conductor and an upper end portion of the hollow cylindrical conductor are formed using a copper foil pattern in a first layer of the dielectric substrate, and a part of the hollow cylindrical conductor and the line conductor are formed using a copper foil pattern in a second layer of the dielectric substrate, and the lower surface conductor is formed using a copper foil pattern in a third layer of the dielectric substrate, wherein the antenna device comprises: a first through hole to electrically connect the outer peripheral portion of the lower surface conductor and the outer peripheral portion of the upper surface conductor, thereby forming the side surface conductor; a second through hole to electrically connect the upper end portion in the hollow cylindrical conductor, a part of the hollow cylindrical conductor, and the lower surface conductor, thereby forming an entire of the hollow cylindrical conductor; and a third through hole to electrically connect a feeding point formed in the first layer of the dielectric substrate using a copper foil pattern, the line conductor, and a feeding point formed in the third layer of the dielectric substrate using a copper foil pattern.

7. An antenna device comprising:

a lower surface conductor having a first hole formed at a center thereof;

an upper surface conductor having a second hole formed at a center thereof, the second hole having a diameter larger than a diameter of the first hole, the upper surface conductor being arranged in parallel with the lower surface conductor in such a way that a central axis of the first hole and a central axis of the second hole correspond to each other;

a side surface conductor to connect between an outer peripheral portion of the lower surface conductor and an outer peripheral portion of the upper surface conductor;

a hollow cylindrical conductor having an inner diameter identical to the diameter of the first hole, and an outer diameter smaller than the diameter of the second hole, a lower end portion thereof being connected to the lower surface conductor in such a way that the central axis of the first hole and a central axis of the inner diameter correspond to each other;

a line conductor having an end thereof connected to a side surface of the hollow cylindrical conductor and which is arranged between the lower surface conductor and the upper surface conductor in parallel with the lower surface conductor;

a short circuiting conductor having an end thereof connected to the lower surface conductor;

a capacitive member having an end thereof connected to another end of the line conductor, and another end thereof connected to another end of the short circuiting conductor; and a feeding point having an end thereof connected to the lower surface conductor and another end thereof connected to the line conductor, the feeding point applying an alternating voltage between the lower surface conductor and the line conductor when connected to a transmitter/receiver, wherein a conductive liquid supplied from the first hole passes through an inside of the hollow cylindrical conductor, and is emitted from the inside of the hollow cylindrical conductor toward an outside.

8. The antenna device according to claim 7, wherein a line length from said end to said another end of the line conductor is equal to or less than one-quarter wavelength at an operating frequency.

* * * * *